US006463159B1

(12) United States Patent
Ming-Cheng

(10) Patent No.: US 6,463,159 B1
(45) Date of Patent: Oct. 8, 2002

(54) BATTERY CASE STRUCTURE OF MICROPHONE OF LOUDSPEAKER SYSTEM

(75) Inventor: Chung Ming-Cheng, Taichung (TW)

(73) Assignee: Taky Electronics Co., Ltd., Ta-Li (TW)

( * ) Notice: Subject to any disclaimer, the term of this patent is extended or adjusted under 35 U.S.C. 154(b) by 0 days.

(21) Appl. No.: 10/046,251

(22) Filed: Jan. 16, 2002

(51) Int. Cl.[7] ..... H04R 25/00

(52) U.S. Cl. ..... 381/355; 381/359; 381/360; 429/100

(58) Field of Search ..... 381/355, 359, 381/360, 361, FOR 147, FOR 148; 429/96, 97, 98, 99, 100

(56) References Cited

U.S. PATENT DOCUMENTS 4,910,795 A * 3/1990 McCowen et al. ..... 381/355

* cited by examiner

*Primary Examiner*—Huyen Le
(74) *Attorney, Agent, or Firm*—Bacon & Thomas, PLLC

(57) ABSTRACT

A microphone battery case is disposed in the hand grip of the microphone and is provided with a battery slot for receiving removably a battery mount on which a plurality of batteries are mounted. The battery slot is provided with a slide rail and a spring. The battery case is provided with two elastic clamp pieces, each having a hook. The battery mount is provided with two hanging frames, and a projection. The battery mount is received in the battery slot such that the projection of the battery mount is guided by the slide rail of the battery slot, and that the spring is compressed by the battery mount, and further that the hanging frames of the battery mount are caught by the hooks of the elastic pieces of the battery case.

2 Claims, 3 Drawing Sheets

BATTERY CASE STRUCTURE OF MICROPHONE OF LOUDSPEAKER SYSTEM

FIELD OF THE INVENTION

The present invention relates generally to a microphone, and more particularly to a battery case structure of the microphone.

BACKGROUND OF THE INVENTION

The conventional microphone battery cases are generally defective in design in that the batteries can not be put into or removed from the battery cases with ease and speed, and that they are not resistant to impact. In light of the battery cases being located in the hand grips of the microphone bodies, the function of the microphone is apt to be adversely affected by an impact exerting on the microphone hand grip. In other words, the microphone is prone to have noise or to be mute when the microphone is impacted inadvertently.

SUMMARY OF THE INVENTION

The primary objective of the present invention is to provide a microphone battery case which is free of the shortcomings of the conventional microphone battery cases described above.

The foregoing objective of the present invention is achieved by the microphone battery case which is provided with two elastic clamp pieces, each having a hook. The battery case is provided with a battery slot, which is in turn provided with a slot rail and a spring. The battery mount is provided with two hanging frames opposite in location to the hooks of the elastic clamp pieces. The battery mount is provided with a projection corresponding in location to the slide rail.

The features and the advantages of the present invention will be more readily understood upon a thoughtful deliberation of the following detailed description of a preferred embodiment of the present invention with reference to the accompanying drawings.

DETAILED DESCRIPTION OF THE PREFERRED EMBODIMENT

Figure 1:
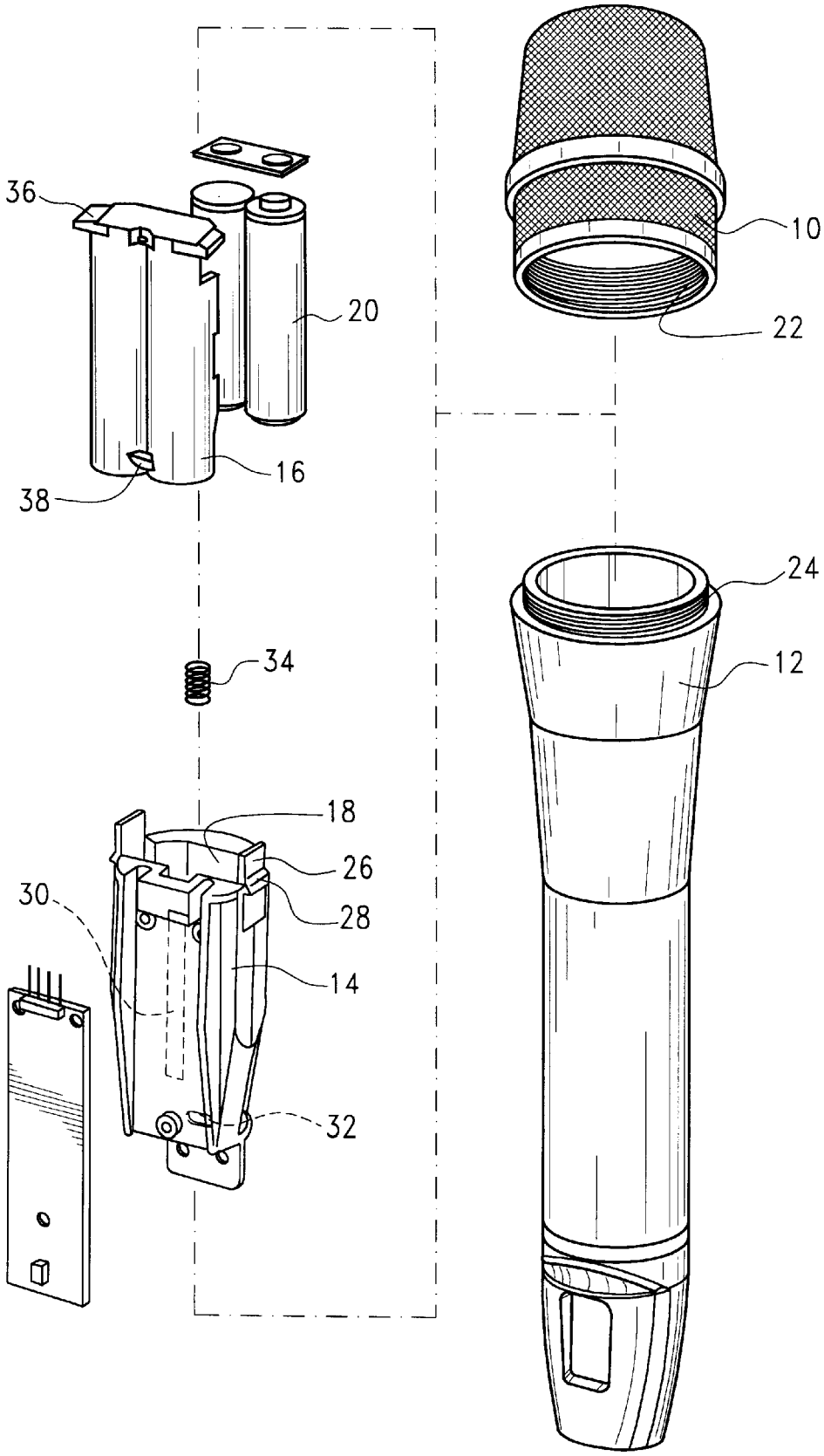
FIG. 1 shows an exploded view of the preferred embodiment of the present invention.
Figure 2:
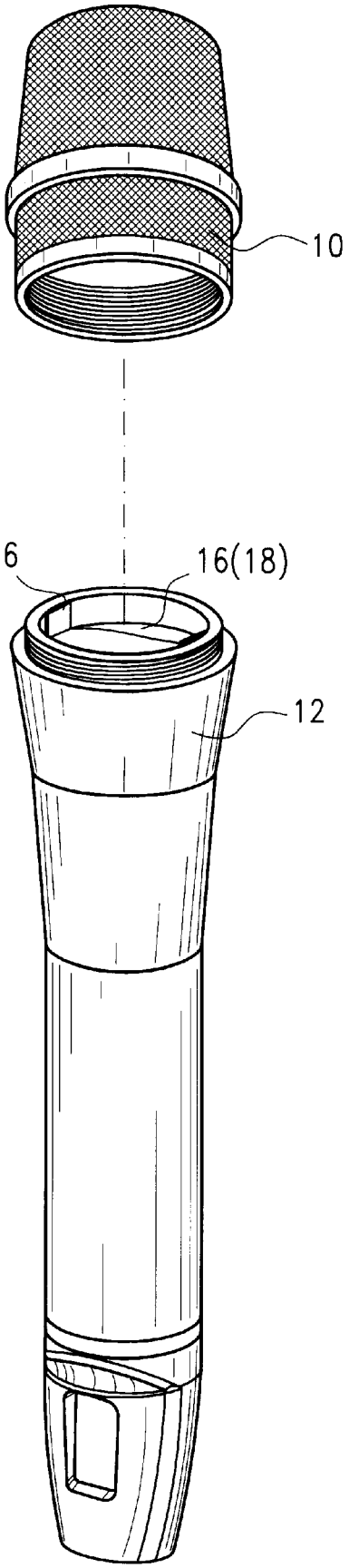
FIG. 2 shows a perspective view of the preferred embodiment of the present invention in combination.
Figure 3:
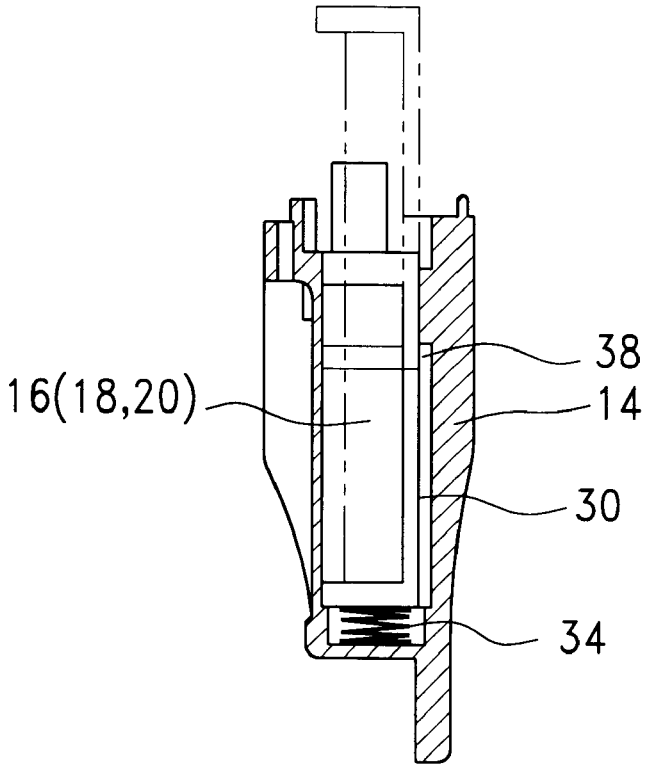
FIG. 3 shows a partial longitudinal sectional view of the preferred embodiment of the present invention.
Figure 4:
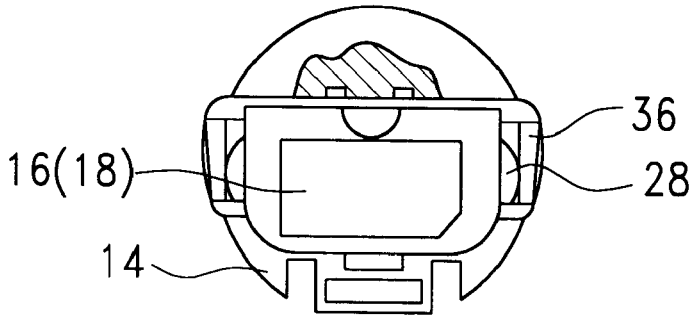
FIG. 4 shows a cross sectional view of the preferred embodiment of the present invention

As shown in all drawings provided herewith, a microphone housing of the present invention comprises a head screen 10, a hand grip 12, a battery case 14, and a battery mount 16.

The head screen 10 is of a cylindrical construction and is provided at an open end thereof with inner threads 22.

The hand grip 12 is provided at the top end with outer threads 24 engageable with the inner threads 22 of the head screen 10.

The battery case 14 is provided with a battery slot 18 and two elastic clamp pieces 26, each having a hook 28. The battery slot 18 is provided with a slide rail 30 extending along the longitudinal direction of the battery slot 18. The battery slot 18 is provided in the bottom with a locating slot 32 in which one end of a spring 34 is located.

The battery mount 16 is used to mount the battery 20 and is corresponding in size and shape to the battery slot 18. The battery mount 16 is received in the battery slot 18. The battery mount 16 is provided with two hanging frames 36 corresponding in location to the hooks 28 of the two elastic clamp pieces 26 of the battery case 14. The battery mount 16 is provided with a projection 38 corresponding in location to the slide rail 30 of the battery slot 18.

The batteries 20 are mounted on the battery mount 16, which is put into the battery slot 18 of the battery case 14 such that the projection 38 of the battery mount 16 is guided by the slide rail 30 of the battery slot 18, and that the bottom of the battery mount 16 comes in contact with the spring 34, and that the hanging frames 36 are caught by the hooks 28 of the elastic clamp pieces 26.

In light of the battery mount 16 being securely held in the battery slot 18 of the battery case 14, the batteries 20 are prevented from slipping out at the time when the head screen 10 is disengaged with the top end of the hand grip 12.

In the process of removing the battery mount 16 from the battery case 14, the elastic clamp pieces 26 of the battery case 14 are bent inwards with fingers, so as to cause the hooks 28 of the elastic clamp pieces 26 to separate from the hanging frames 36. The battery mount 16 is then ejected by the spring force of the spring 34 such that the projection 38 of the battery mount 16 is retained by the end of the slide rail 30, thereby preventing the battery mount 16 from slipping out of the battery case 14.

The embodiment of the present invention described above is to be regarded in all respects as being merely illustrative and nonrestrictive. Accordingly, the present invention may be embodied in other specific forms without deviating from the spirit thereof. The present invention is therefore to be limited only by the scopes of the following claims.

What is claimed is:

1. A microphone comprising:

a hand grip;

a head screen engaged with a top end of said hand grip;

a battery case located in the top end of said hand grip and provided with a battery slot; and a battery mount for mounting a plurality of batteries in said battery slot of said battery case, said battery mount being removably received in said battery slot of said battery case;

wherein said battery case is provided with two elastic clamp pieces, each having a hook, said battery slot of said battery case being provided with a slide rail and a spring;

wherein said battery mount is provided with two hanging frames corresponding in location to said hooks of said elastic clamp pieces of said battery case, said battery mount being further provided with a projection corresponding in location to said slide rail of said battery slot whereby said battery mount is removably received in said battery slot of said battery case such that said projection of said battery mount is guided by said slide rail of said battery slot, and that the bottom of said battery mount comes in contact with said spring, and further that said hanging frames of said battery mount are caught by said two hooks of said elastic clamp pieces of said battery case.

2. The microphone as defined in claim 1, wherein said battery slot of said battery case is provided with a location slot; wherein said spring is located in said battery slot of said battery case in such a manner that one end of said spring is located in said locating slot of said battery slot of said battery case.

* * * * *